United States Patent [19]

Diard et al.

[11] Patent Number: 4,993,549

[45] Date of Patent: Feb. 19, 1991

[54] PACKAGING AND PROCESS OF PACKAGING A SKI

[75] Inventors: Jean-Luc Diard, Annecy; Yves Gagneux, Annecy le Vieux, both of France

[73] Assignee: Salomon S.A., Annecy Cedex, France

[21] Appl. No.: 276,459

[22] Filed: Nov. 28, 1988

[30] Foreign Application Priority Data

Dec. 4, 1987 [FR] France ..... 87 17255

[51] Int. Cl.[5] ..... B65D 75/58

[52] U.S. Cl. ..... 206/315.1; 206/497; 206/610

[58] Field of Search ..... 206/315.1, 601, 604, 206/620, 634, 497, 608, 610, 628, 605, 45.33; 224/917

[56] References Cited

U.S. PATENT DOCUMENTS

| | | | |
|---|---|---|---|
| 1,869,313 | 7/1932 | Mackay | 206/610 |
| 1,949,121 | 2/1934 | Herder | 206/610 |
| 3,273,302 | 12/1963 | Walter | 206/497 |
| 3,339,607 | 9/1965 | Howard | 206/315.1 |
| 3,442,436 | 5/1969 | Kirby, Jr. | 206/497 |
| 3,526,315 | 9/1970 | Killian . | |
| 3,631,899 | 1/1972 | Erickson . | |
| 3,653,497 | 4/1972 | Hornstein | 206/497 |
| 3,712,464 | 1/1973 | Chapman et al. | 206/45.33 |
| 3,851,689 | 12/1974 | Kohls | 206/315.1 |
| 3,896,981 | 7/1975 | Purple . | |
| 4,012,050 | 3/1977 | Miller | 150/154 |
| 4,191,233 | 3/1980 | McKay | 206/315.1 |
| 4,319,617 | 3/1982 | Fusaro | 206/315.1 |
| 4,385,697 | 5/1983 | Urban et al. | 206/497 |
| 4,586,312 | 5/1986 | Limousin . | |
| 4,652,490 | 3/1987 | Arita et al. . | |
| 4,715,416 | 12/1987 | Horne | 206/315.1 |
| 4,815,509 | 3/1989 | Owen | 206/315.1 |

FOREIGN PATENT DOCUMENTS 2109817 9/1972 Fed. Rep. of Germany .

*Primary Examiner*—Jimmy G. Foster

*Attorney, Agent, or Firm*—Sandler, Greenblum & Bernstein

[57] ABSTRACT

Packaging for a ski and a process of packaging the ski. The packaging provides an attractive envelope for the ski and protects the ski from the time it is manufactured until its retail sale, and further, until the ski is first used, i.e., even after the bindings are mounted thereon. The packaging protects and surrounds all parts of the ski and includes a sleeve of thermo-shrinkable plastic material. At areas upon which the ski bindings are to be mounted, zones of reduced resistance to tearing are produced so that, at the place of distribution of the skis, such zones can be conveniently removed without the removal of the remainder of the packaging. The process includes the steps of introducing a ski into a sleeve; closing the ends of the sleeve by, e.g., welding; and passing the ski wrapped in the sleeve through a thermo-shrinking tunnel.

14 Claims, 6 Drawing Sheets

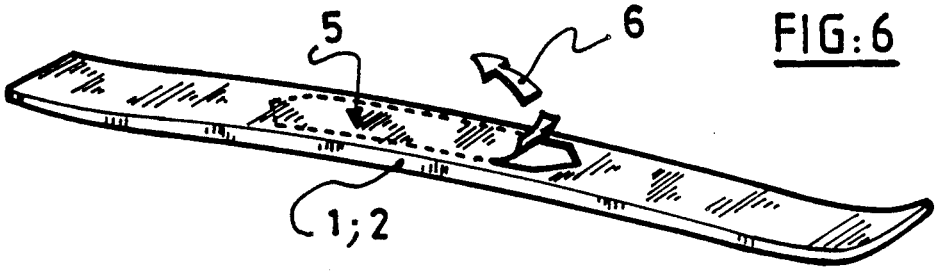
FIG:6
FIG:7
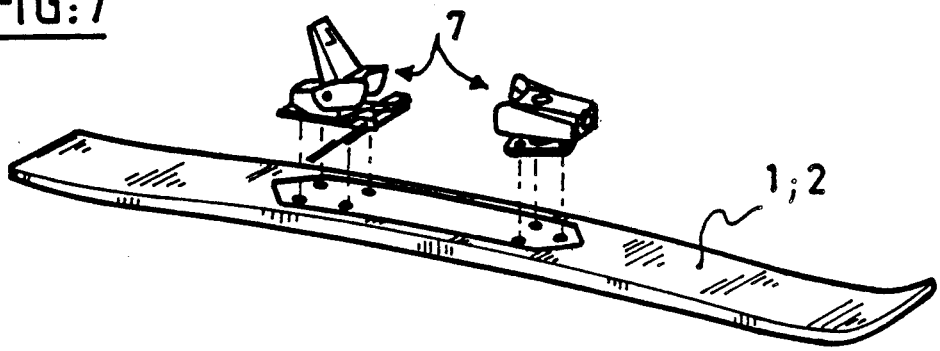
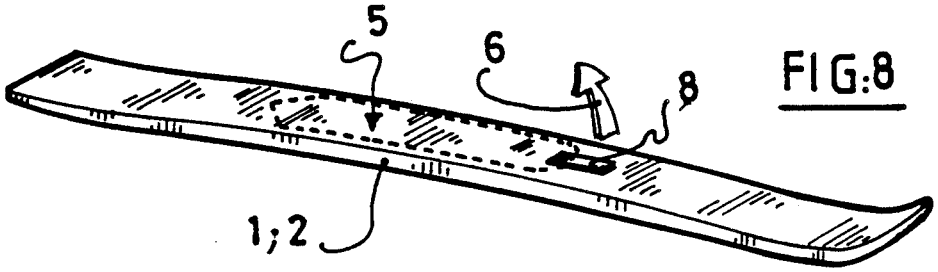
FIG:8
FIG:9
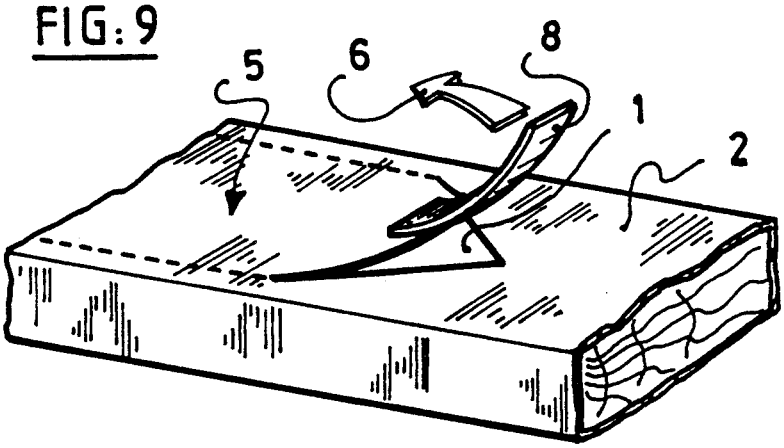
FIG:10
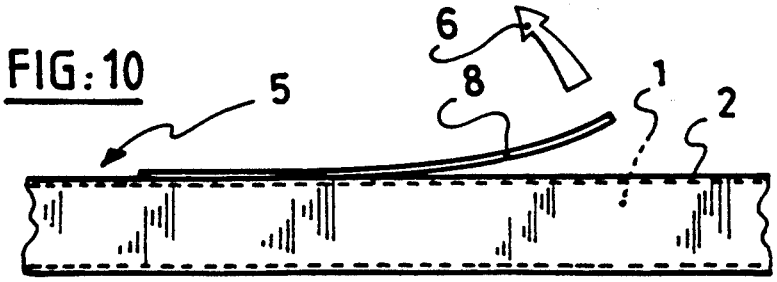

PACKAGING AND PROCESS OF PACKAGING A SKI

BACKGROUND OF THE INVENTION

1. Field of the Invention

The present invention relates to packaging for skis which serves to protect them and which allows for their display for commercial sale. It relates more particularly to a type of packaging and its process of manufacture.

2. Description of Background and Relevant Information

After the manufacture of skis, but before the skis leave the factory and enter into commerce, it is known to package them for protection from possible deterioration before their final sale to the user. The most common technique consists of wrapping the skis with sheets of thick and opaque polyethylene, which may or may not be folded at the two ends of the skis to form small pouches which are then stapled closed. Thus prepared, the skis have an appearance which is far from being attractive. Also, it is not uncommon that the skis are placed in an exposed fashion in the retail shop well before their sale to the purchaser, which leaves them in a situation which risks damage. Even if this is not the case, and the user wants to mount the bindings before carrying off his skis, it is necessary to remove the skis from their package for the operation of mounting the bindings. Besides the fact that this operation may possibly damage the exposed skis, it is no longer possible, after mounting the bindings, to reintroduce the skis in their protective package, which then exposes them to the risk of deterioration by handling or transport.

SUMMARY OF THE INVENTION

The disadvantages mentioned above with regard to the prior art of packaging skis are overcome by the present invention which includes a closed envelope, made of thermo-shrunk plastic material for protecting and surrounding the ski, wherein the envelope includes at least one zone defined by a tear line corresponding to the location for the mounting of the bindings.

According to the present invention, the plastic material is preferably transparent and can be made of, for example, polyvinylchloride. The thickness of the plastic material, prior to its being thermo-shrunk, is approximately 40–60 microns. Further, the plastic material is bidirectional and has an initial thermo-shrinking ability of approximately 5–8% longitudinally and approximately 40% transversely.

According to a further aspect of the present invention, each of the zones includes at least a tongue which facilitates the removal of the zone. This tongue is preferably glued or welded at each zone and extends over the remainder of the packaging.

According to a further aspect of the present invention, each zone is defined by a tear line situated under the sole of the ski and, according to a further aspect of the present invention, a zone is defined by a tear line localized at a lateral side of the ski.

According to a still further aspect of the present invention, a protective plate is positioned at least at one of the zones, positioned between the ski and the envelope. The plate can include indicators which correspond to the locations where holes for mounting of the ski bindings are to be formed. The plates can further be made of cardboard material.

The process according to the present invention includes at least the steps of: introducing a ski into a sleeve of thermal-shrinkable plastic material having a length and width greater than that of the ski; welding the sleeve closed at least at one end; and passing the ski wrapped in the sleeve through a thermo-shrinking apparatus.

According to one aspect of the process, the step of welding closes the sleeve along directions which converge from the side of the spatula of the ski.

According to a further aspect of the process, the process includes the step of forming a tear line in the packaging to define at least one zone corresponding to areas for receiving the bindings of the ski.

According to a further aspect of the process, the process includes the step of providing a tongue on at least one of the zones to facilitate the tearing of the packaging in that zone.

According to a still further aspect of the process, the process includes, before the step of welding the sleeve, the step of positioning a plate on at least one zone to protect the surface of the ski during the step of forming the zone.

In summary, the apparatus and process of the present invention results in a sleeve for protecting the ski, wherein the sleeve comprises at least one portion which includes means for facilitating the removal of that portion while leaving the remainder of the sleeve intact. The sleeve is formed of plastic, preferably heat-shrinkable material, in which the means for facilitating the removal of the portion includes a portion of the sleeve which has been treated to form an area of reduced resistance to tearing. This area of reduced resistance can include at least one line, which can be perforated, or merely a line of lessened thickness in the sleeve.

BRIEF DESCRIPTION OF THE DRAWINGS

The invention will now be described with reference to certain characteristics and advantages which will become clear from the description which follows whose understanding will be facilitated with reference to the annexed drawings in which:

FIGS. 6 and 7 illustrate the mounting of the bindings without the removal of the packaging, except in the zone adapted for the binding.

FIGS. 8–10 illustrate a particular embodiment of the packaging;

DESCRIPTION OF PREFERRED EMBODIMENTS

The present invention attempts to overcome the disadvantages of the present state of the art by proposing an attractive packaging whose protective role extends from the time the skis are finished until their retail sale, or even, until their first use, i.e., even after the mounting of the bindings. The packaging protects the surfaces of the ski against damage such as scratches, dust, or dirt which might otherwise result from exposure of the ski prior to, during, as well as after sale of the skis.

The packaging of a ski according to the invention includes an envelope which is closed at all sections and protects and likewise surrounds all of the parts of the ski. This envelope is constituted of a thermo-shrinkable plastic material. Preferably, this material is transparent, permitting the ski to remain constantly visible to the user. Polyvinylchloride lends itself extremely well to this use, and particularly the "crystal" type, which assures an excellent aesthetic appearance and thus a high attractiveness, particularly at the place of distribution. This packaging protects the ski, as well as its undersurface, against dust and scratches, and the transparency of the packaging guarantees at all times that the ski will maintain all the characteristics of its initial finishing upon leaving the factory. This packaging also protects against the corrosion of the edges of the ski. This conditioning is achieved in the manner illustrated in FIGS. 1–4.

Figure 1:
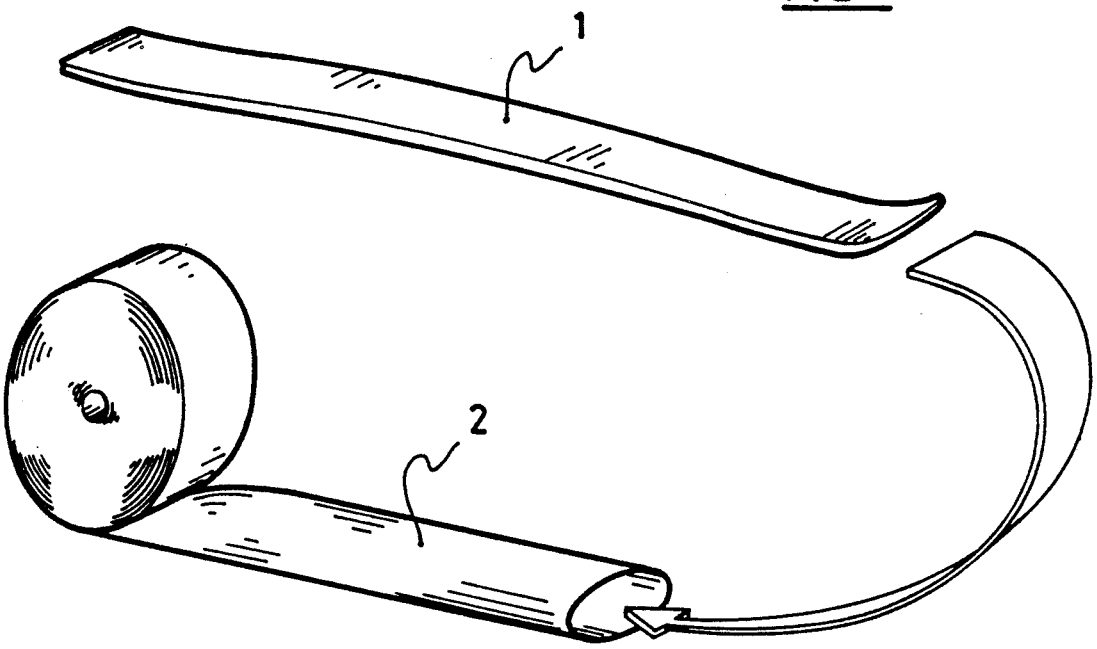
FIGS. 1–5 illustrate the respective steps in producing the ski packaging according to the invention.

In FIG. 1 there is shown a ski 1 in its form as a finished product. It is introduced into a sleeve 2 of appropriate plastic material, of a predetermined width, when flat, and of a length greater than that of the ski 1. Sleeve 2 can be precut or fed by a roller (as shown) and then cut to the desired length.

Figure 2:
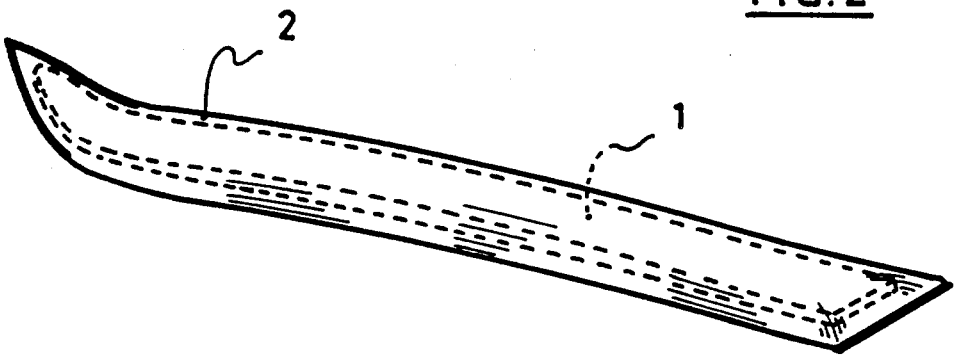

The precut sleeve 2 containing ski 1 is then welded closed at its two ends by a known manner of welding, transversely to the side of the heel of the ski, and preferably, in a converging fashion from the side of the spatula of the ski, to correspond to the shape of the ski and, ultimately, to mate with it. The result shown in FIG. 2 is thus obtained.

Figure 3:
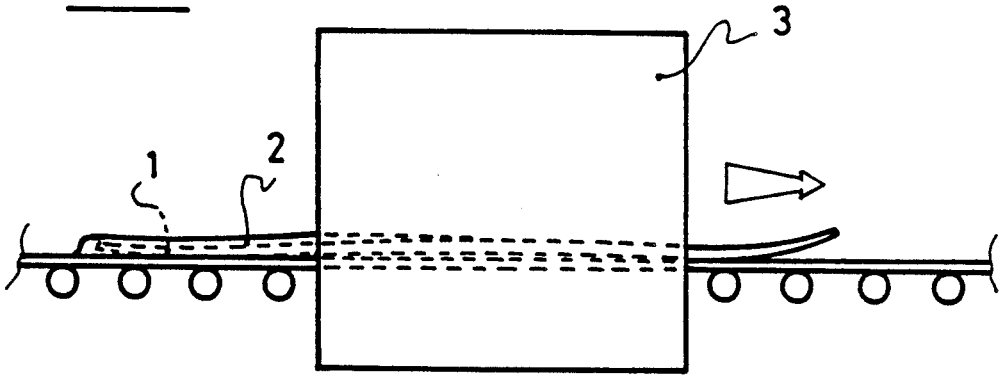
Figure 4:
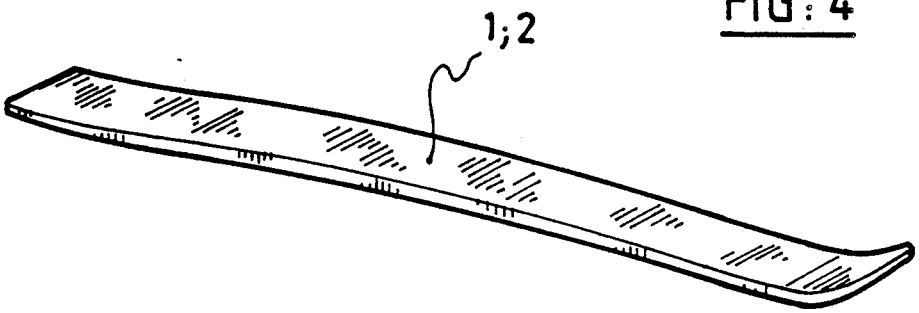

Ski 1 packaged in sleeve 2 then passes, as illustrated in FIG. 3, through a conventional heat shrink tunnel 3, with hot air convection, to come out packaged as in FIG. 4 where the sleeve 2 is shrunk to press perfectly against all of the parts of the ski 1, without any folds.

Excellent results are obtained with a sleeve 2 having an original thickness of approximately 40–60 microns in a material which is preferably bi-oriented and having initially a transverse shrinking ability of about 40% and a longitudinal shrinking ability of about 5–8%. An original flat width of about 100–120 millimeters is thus appropriate for a normal ski. Under these conditions, a thermo-shrink tunnel 3 of a length on the order of 1.10 meters with a speed of transit on the order of 11 meters per minute, and a working temperature on the order of 150° C. is perfectly appropriate for the result sought.

Ski 1 thus packaged in sleeve 2 can be offered for sale and taken away by the purchaser in this condition illustrated in FIG. 4.

If in a retail store the buyer would like to have bindings mounted, the retail technician can, by cutting it away adjacent the surface necessary for the binding mounting operations, eliminate the protective film constituted by the original sleeve 2, now forming the package, without removing the film over the remainder of the ski. The protective package 2 will continue to maintain the surface of ski 1 protected from accidents, such as scratches, which the binding mounting operation may otherwise cause by the carelessness of the operator or other circumstances. Once the mounting has been performed, the purchaser can carry away his skis 1 still protected, except in the zone or zones where the binding elements 7 have been attached.

To facilitate the partial removal of the packaging in the one or more zones for the mounting of the bindings, without the deterioration of the packaging more than is necessary or useful, one can, according to the invention, predefine this zone or zones by tear lines. This is illustrated in FIGS. 5–7.

Figure 5:
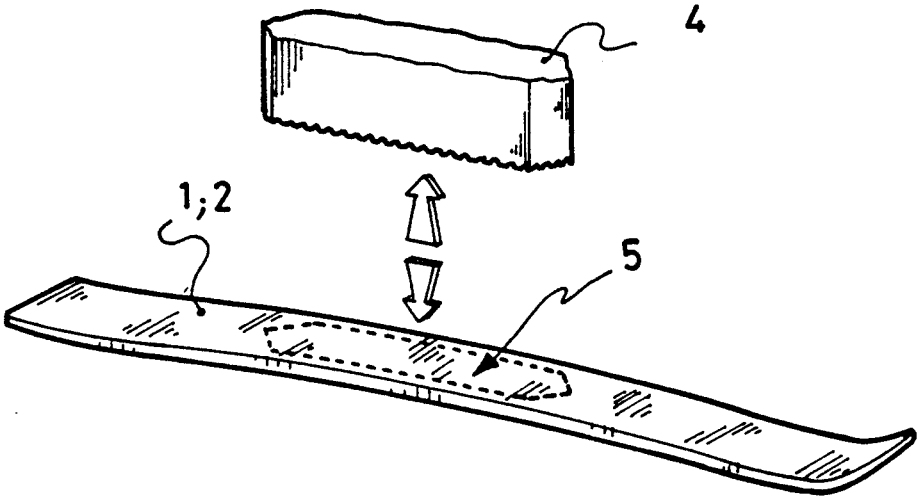

In FIG. 5, the packaged ski of FIG. 4 is shown undergoing the operation of forming a tear line, which defines a mounting zone 5 of the bindings of ski 1. The process of forming a tear line per se is well known to one of ordinary skill in the art who packages with plastic film for other products. The present invention, however, includes the application of the process for this particular field of endeavor with its specific and particular requirements.

A tool 4 which is constituted and appropriately configured is used against the upper surface of the packaged ski 1, 2 to define an area of reduced resistance of the package 2, defining the zone 5 provided for the mounting of the bindings. According to the option selected, this area can be formed by the working tool 4 by means of a succession of points, small segments or short lines, perforations, or by a continuous line of reduced resistance which takes the form of a line recessed in the surface of the package 2. Preferably, one can give to this area the shape of a corner, positioned, as in FIG. 5, in front and/or to the rear, to facilitate the tearing without destruction of the package when it is no longer necessary or desired. FIG. 6 illustrates this removal operation, which is performed by the tearing away of this single zone 5 in the direction of arrow 6, without damaging the rest of the packaging 2. In FIG. 7, the mounting of binding 7 is illustrated, where zone 5 of the packaging 2 is torn away, exposing the upper surface of the ski.

To facilitate the removal of zone 5 of packaging 2, without removing the remainder of the packaging, as described above, it is advantageous to provide zone 5 with a tongue 8 affixed, for example by gluing or welding or the like, and extending the tongue 8 by a free end over the rest of the package 2 of ski 1. The removal operation, symbolized by the arrow 6, is illustrated in FIGS. 8 and 9. FIG. 10 illustrates the details of the tongue 8 affixed before removal of zone 5, and bordering on and extending freely beyond its other end on the package 2.

Depending upon the final thickness of the package 2, the tool 4 utilized, and the skill of the operator performing the cut-away operation or the precutting of zone 5 provided for the mounting of binding 7, within the packaging operation itself of ski 1 a supplemental form of protection can be provided.

Figure 11:
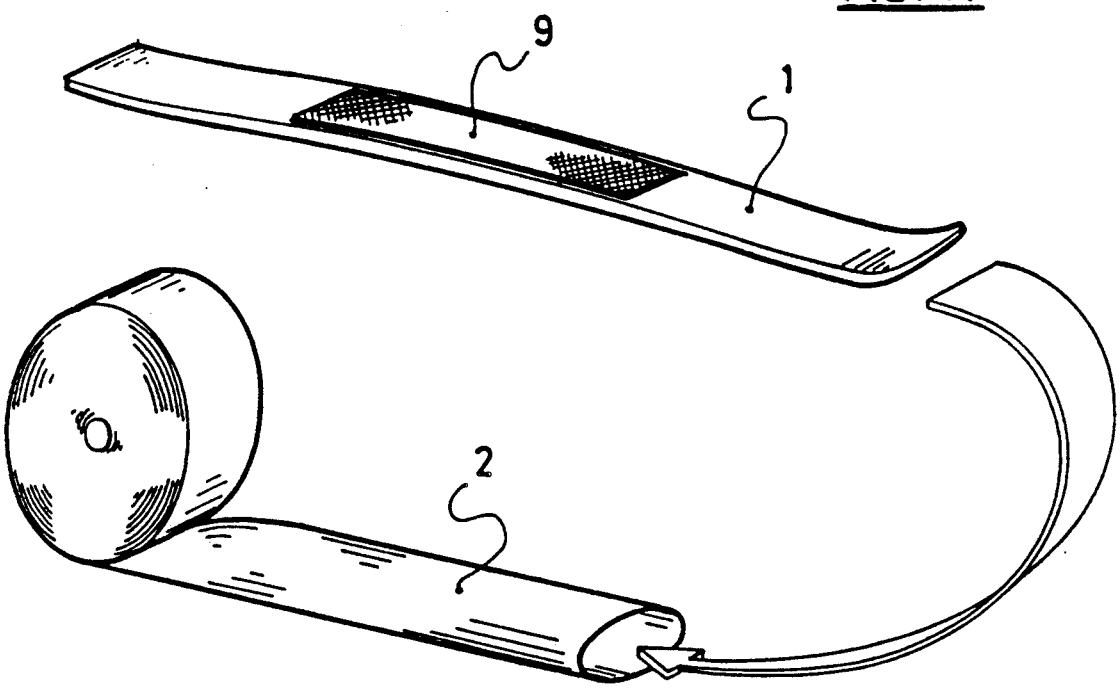
FIGS. 11–14 illustrate an improved embodiment of the packaging according to FIGS. 5-7; and In FIGS. 15–18 illustrate alternative embodiments.
Figure 12:
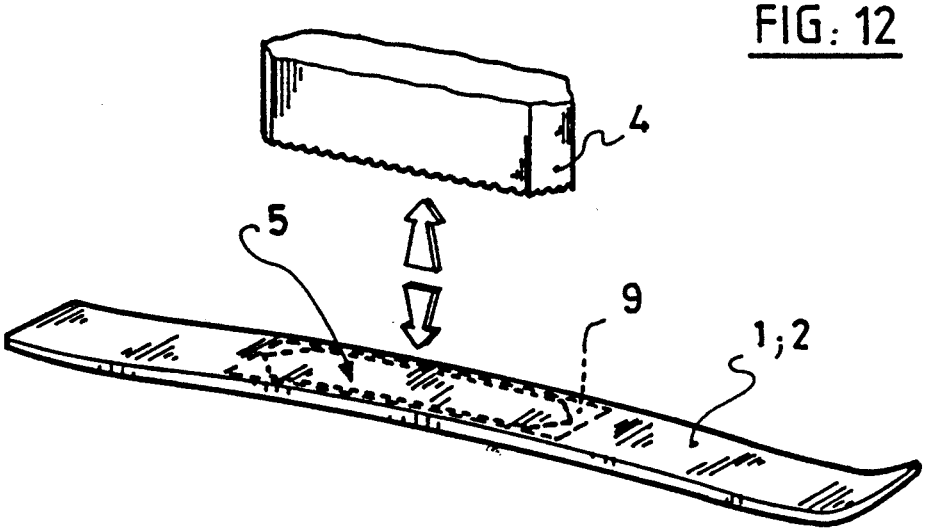
Figure 13:
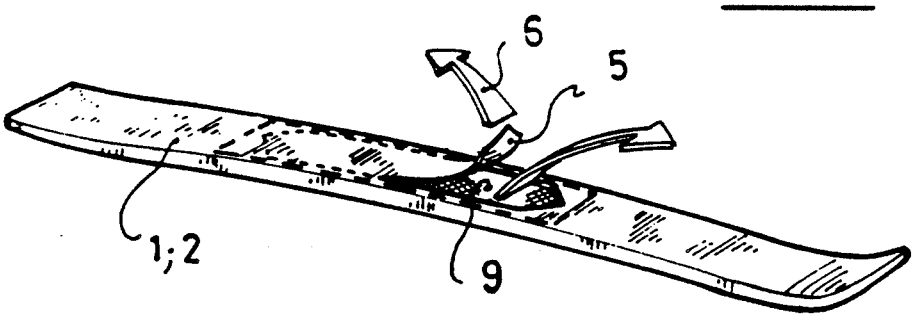
Figure 14:
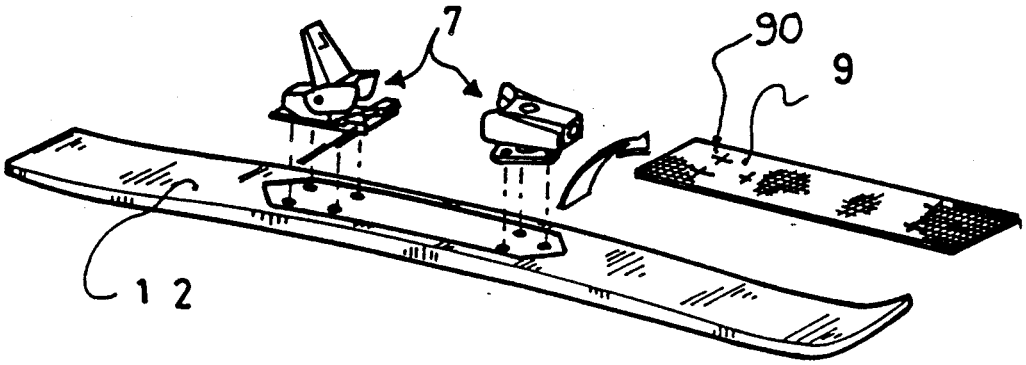

To achieve this, as illustrated in FIG. 11, a protective plate 9, or more than one plate, is placed upon ski 1 at locations adapted for the positioning of the binding elements, before introduction of ski 1 into sleeve 2. The welding operations of the ends of sleeve 2 and the thermal shrinking in appropriate tunnel 3 occur as previously described. The one or more plates 9 offer a supplemental protection to the upper surface of the packaged ski for the operation of defining the one or more zones 5 adapted for an ultimate preliminary removal prior to the mounting of the binding elements 7. Thus, as illustrated in FIG. 12, by forming the area of lesser resistance of the one or more zones 5, the tool 4 can in no case, even by the carelessness of the operator, damage the upper surface of ski 1. Preferably, the one or more small plates 9 can be made from cardboard sheet material. The remaining operations for the ultimate mounting of the bindings remain substantially identical to those previously described. However, after removal of zone 5 in the direction of arrow 6, as illustrated in FIG. 13, the plate 9 is removed before the placement of the binding elements 7 in position on the upper ski surface, as illustrated in FIG. 14. The cardboard plate has a dimension greater than the cut-away surface such that it can be ensured that the cardboard plate can be positioned at least where the cutting away occurs. The cardboard can preferably include indicators 90 corresponding to the locations where holes are to be formed in the ski for the mounting of the bindings.

Figure 15:
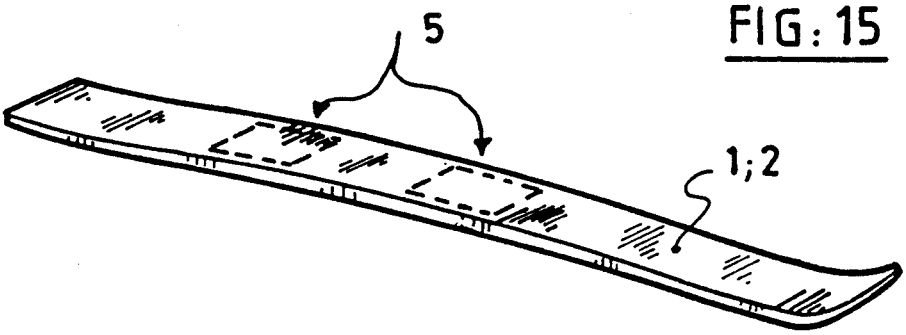

FIG. 15 schematically illustrates the case where the binding elements can be mounted on the ski at a plurality of separate locations or zones. All which has been previously stated applies to this case without any difficulty, whatever the number and the surface of the zones to be removed for the mounting of any elements, bindings, or for any other reason, and without affecting the protective package 2 of the ski according to the invention.

Figure 16:
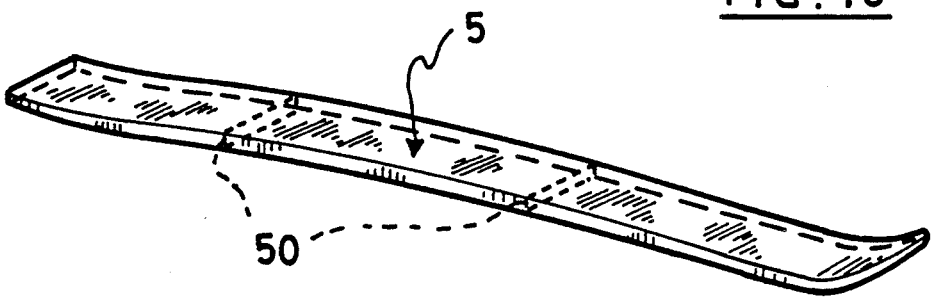
Figure 17:
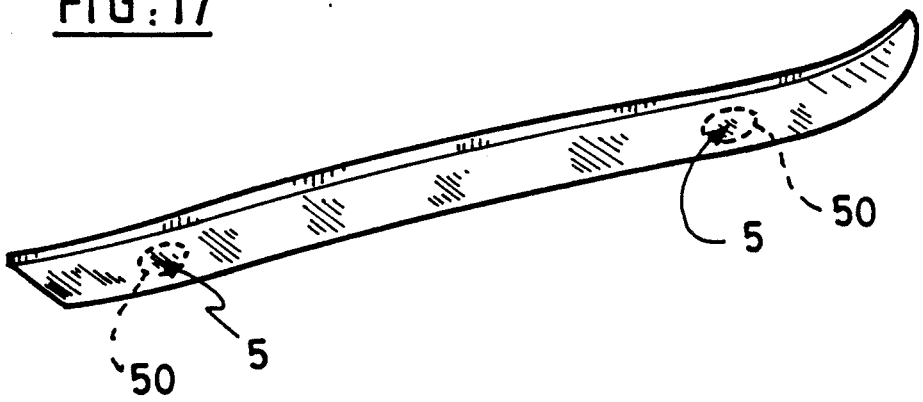
Figure 18:
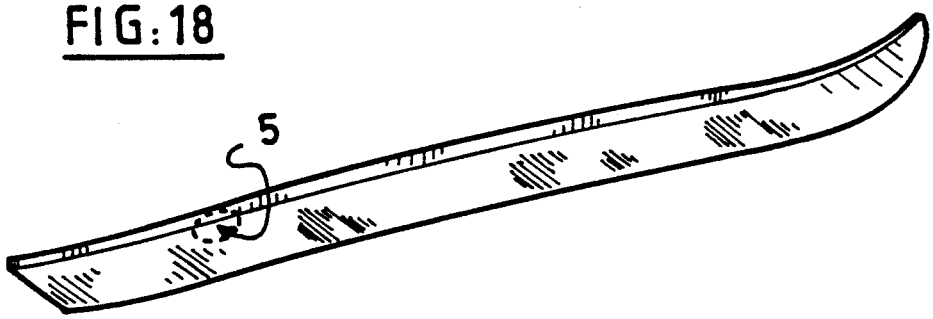

FIGS. 16, 17, and 18 illustrate variations according to the present invention.

FIG. 16 is a perspective view of a wrapped ski in which the precut tear zone 5 is such that the precut formed by the tear lines 50 surrounds the ski.

FIG. 17 is a perspective view showing, more particularly, the bottom of the ski and showing a variation in which one or more precut tear zones 5 are made on the side of the sole of the ski. This arrangement makes it possible at these zones, after shrinkage of the package, to be able to verify the state and the preparation of the sole.

FIG. 18 is a view similar to FIG. 17 showing a variation according to which a precut zone 5 is positioned both on the sole of the ski and on the lateral side thereof. This arrangement makes possible, after shrinkage of the package, to be able to verify at the precut zone the state and the preparation of the edges.

Although the invention has been described with reference to particular means, materials and embodiments, it is to be understood that the invention is not limited to particulars disclosed and extends to all equivalents within the scope of the claims.

What is claimed is:

1. A packaged ski comprising:

(a) a ski having at least one area at which at least one binding element is adapted to be affixed; and (b) an envelope of thermo-shrinkable material surrounding said ski, said envelope having at least one zone which corresponds to said at least one area of said ski at which said at least one binding element is adapted to be affixed, wherein said at least one zone is defined by at least one tear line.

2. The packaged ski according to claim 1, wherein said plastic material is transparent.

3. The packaged ski according to claim 1, wherein said plastic material is polyvinylchloride.

4. The packaged ski according to claim 1, wherein said plastic material has a thickness, prior to being thermoshrunk, of about 40–60 microns.

5. The packaged ski according to claim 1, wherein said plastic material is bi-directional.

6. The packaged ski according to claim 5, wherein said plastic material has an initial thermo-shrinking ability of approximately 5–8% longitudinally and approximately 40% transversely.

7. The packaged ski according to claim 1, wherein each said zone has a tongue adapted to facilitate removal of each said zone.

8. The packaged ski according to claim 7, wherein said tongue is glued or welded at each said zone and extends freely over the remainder of said packaged ski.

9. The packaged ski according to claim 1, wherein said at least one zone comprises a zone defined by a tear line situated under the sole of the ski.

10. The packaged ski according to claim 1, wherein said at least one zone comprises a zone defined by a tear line localized both under the sole of the ski and on a lateral side of the ski.

11. The packaged ski according to claim 1, further comprising a protective plate extending beyond at least one of said at least one upper zone, positioned between the ski and said envelope.

12. The packaged ski according to claim 11, wherein one said protective plate comprises indicators corresponding to locations where holes for the mounting of ski bindings are to be formed.

13. The packaged ski according to claim 11, wherein said protective plate is made from cardboard.

14. A packaging for a ski, comprising (a) a closed envelope, made of thermo-shrunk plastic material protecting and surrounding the ski, and wherein said envelope comprises at least one zone defined by a tear line corresponding to the location for the mounting of bindings upon the ski;

(b) a protective plate extending beyond at least one of said at least one zone, positioned between the ski and said envelope, and wherein said protective plate comprises indicators corresponding to locations where holes for the mounting of the bindings are to be formed.

* * * * *